US010689779B2

(12) United States Patent
Baier et al.

(10) Patent No.: US 10,689,779 B2
(45) Date of Patent: Jun. 23, 2020

(54) THREAD-GUIDING UNIT, OPEN-END SPINNING MACHINE AND METHOD FOR OPERATING A SPINNING STATION

(71) Applicant: Rieter Ingolstadt GmbH, Ingolstadt (DE)

(72) Inventors: Frank Baier, Hohenwart (DE); Robert Hagl, Rottenegg (DE); Thomas Gruber, Ingolstadt (DE); Christian Kettner, Koesching (DE); Mario Maleck, Walting (DE); Robin Wein, Ingolstadt (DE); Markus Kuebler, Geislingen (DE); Andreas Frank, Laichingen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 130 days.

(21) Appl. No.: 15/661,659

(22) Filed: Jul. 27, 2017

(65) Prior Publication Data

US 2018/0030624 A1 Feb. 1, 2018

(30) Foreign Application Priority Data

Jul. 28, 2016 (DE) ..... 10 2016 113 963

(51) Int. Cl.

| | |
|---|---|
| ***D01H 4/40*** | (2006.01) |
| ***D01H 4/02*** | (2006.01) |
| ***D01H 4/22*** | (2006.01) |

(52) U.S. Cl.

CPC ..... *D01H 4/40* (2013.01); *D01H 4/02* (2013.01); *D01H 4/22* (2013.01)

(58) Field of Classification Search

CPC .. D01H 4/40; D01H 4/50; D01H 4/02; D01H 4/06; D01H 4/04; D01H 4/22; D01H 4/24; D01H 4/38; D01H 4/48

(Continued)

(56) References Cited

U.S. PATENT DOCUMENTS 2,928,228 A * 3/1960 Gotzfried ..... D01H 4/02 57/403
3,655,862 A * 4/1972 Dorschner et al. .... B65H 51/16 226/7

(Continued)

FOREIGN PATENT DOCUMENTS

DE 25 34 816 2/1977
DE 196 24 537 A1 1/1998

(Continued)

OTHER PUBLICATIONS

German Seaerch Report, dated Mar. 2, 2017.
EP Search Report, dated Dec. 22, 2017.

*Primary Examiner* — Shaun R Hurley
*Assistant Examiner* — Patrick J. Lynch
(74) *Attorney, Agent, or Firm* — Dority & Manning, P.A.

(57) ABSTRACT

A thread guide unit is used for drawing off a thread out of a rotor of a spinning unit of an open-end spinning machine. The thread guide unit includes a draw-off tube, and a compressed air nozzle configured with the draw-off tube. A thread outlet element extends into the draw-off tube. The compressed air nozzle includes a mouth formed as a gap between an inner diameter surface of the draw-off tube and the thread outlet element. A method for operating a spinning unit of an open-end spinning machine having the thread guide unit is also provided.

13 Claims, 8 Drawing Sheets

(58) Field of Classification Search
USPC ..... 57/263, 400, 411, 415, 401
See application file for complete search history.

(56) References Cited

U.S. PATENT DOCUMENTS 4,030,280 A * 6/1977 Folk ..... D01G 13/00 19/106 R
4,114,356 A * 9/1978 Eckhardt ..... D01H 4/50 57/263
4,174,605 A * 11/1979 Pallay ..... D01H 4/02 57/333
4,319,448 A * 3/1982 Jozwicki ..... D01H 4/02 57/403
4,322,942 A * 4/1982 Fajt ..... D01H 4/00 57/333
4,553,383 A * 11/1985 Didek ..... D01H 4/02 57/403
4,665,687 A * 5/1987 Ott ..... D01H 4/40 57/414
4,845,932 A * 7/1989 Sakai ..... D01H 1/115 57/5
5,647,197 A * 7/1997 Imamura ..... D01H 1/115 57/315
5,718,110 A * 2/1998 Stahlecker ..... D01H 4/10 57/404
5,787,699 A * 8/1998 Morishita ..... D01H 4/50 57/263
6,029,435 A * 2/2000 Okamoto ..... D01H 15/002 57/261
6,094,901 A * 8/2000 Schermer ..... D01H 4/40 57/301
2003/0029153 A1* 2/2003 Straaten ..... D01H 4/50 57/263
2008/0276594 A1* 11/2008 Stahlecker ..... D01H 1/115 57/403
2009/0094958 A1* 4/2009 Weide ..... D01H 1/115 57/263
2017/0314167 A1* 11/2017 D'Agnolo et al. ..... D01H 4/02

FOREIGN PATENT DOCUMENTS

DE 197 18 768 A1 11/1998
DE 698 08 691 T2 6/2003
GB 1 497 391 1/1978

* cited by examiner

THREAD-GUIDING UNIT, OPEN-END SPINNING MACHINE AND METHOD FOR OPERATING A SPINNING STATION

FIELD OF THE INVENTION

The present invention relates to a thread guide unit for drawing off a thread from a rotor of a spinning unit of an open-end spinning machine with a draw-off tube and a compressed air nozzle.

Furthermore, the invention relates to an open-end spinning machine with a multiple number of spinning units, whereas each spinning unit features a spinning assembly, a thread guide unit, draw-off rollers, a winding unit and a thread piecing unit, along with a method for operating a spinning unit of an open-end spinning machine, whereas a spinning assembly produces a thread, the thread is drawn off by draw-off rollers through a thread guide unit and is wound by a winding unit onto a bobbin, and, if the thread must be pieced, a thread piecing unit moves a thread end to the thread guide unit, where the thread end is initially fed into the thread guide unit by a negative pressure prevailing in the spinning assembly and is then sucked into the spinning assembly.

BACKGROUND

An open-end spinning machine with a thread draw-off tube and a thread guide tube arranged at a distance from the thread draw-off tube with an ejector nozzle is known from German patent document DE 25 34 816. However, this device has a relatively large need for space.

To remedy a thread breakage, DE 25 34 816 proposes returning the torn thread end into the spinning rotor. For this purpose, both an induced draft in the rotor housing is switched on and the ejector nozzle is put into operation. Then, draw-off rollers are rotated back in their direction of rotation, which is reversed during the normal spinning process, whereas the returned thread piece is blown through the ejector nozzle into a thread outlet opening of the thread draw-off tube and is further drawn in by the prevailing induced draft. The thread is then separated by means of a thread cutting device. Subsequently, the pair of draw-off rollers are again rotated back, and by this the returned thread piece is blown back into the thread outlet opening by means of the ejector nozzle. The pair of draw-off rollers are now turned back by an amount such that the thread ends are conveyed back precisely into the fiber collection groove of the spinning rotor through the thread draw-off tube. There, they connect with the deposited fibers, thus eliminating the thread breakage. At that point, the pair of draw-off rollers is switched back to forward running and the ejector nozzle is put out of operation. In the course of this process, however, a large amount of compressed air is required for the operation of the ejector nozzle.

SUMMARY OF THE INVENTION

Thus, a task of the present invention is to reduce the specified disadvantages and to further improve the device and the method. Additional objects and advantages of the invention will be set forth in part in the following description, or may be obvious from the description, or may be learned through practice of the invention.

The tasks are solved by a thread guide unit, an open-end spinning machine and a method for operating a spinning unit of an open-end spinning machine with the characteristics set forth herein.

A thread guide unit for drawing off a thread from a rotor of a spinning unit of an open-end spinning machine with a draw-off tube and a compressed air nozzle is proposed. Upon spinning operation, the thread coming from the rotor is thus drawn off through the draw-off tube of the thread guide unit. A thread end must be pieced at certain times, for example after a thread break or a clearer cut. A clearer cut is the deliberate separation of the thread because it does not have the desired properties such as, for example, thickness or purity. In order to piece the thread end, it must be brought back into the rotor through the draw-off tube of the thread guide unit. Such movement of the thread end is assisted by a directed compressed air flow that emerges from the compressed air nozzle.

According to the invention, a thread outlet element is provided and a mouth of the compressed air nozzle is formed as a gap between the draw-off tube and the thread outlet element. In doing so, the thread outlet element allows a gentle exit of the thread from the thread guide unit. This is achieved in particular through a rounded shape and/or a low-friction surface of the thread outlet element. Given that the mouth of the compressed air nozzle is designed as a gap between the draw-off tube and the thread outlet element, a particularly compact design can be achieved.

Advantageously, the mouth of the compressed air nozzle is ring-shaped. In this way, the thread is evenly circulated, which most effectively utilizes the compressed air and treats the thread in the most gentle manner. However, the mouth of the compressed air nozzle can also be semi-circular, which directs the thread in the direction of one side of the draw-off tube and is particularly advantageous in conjunction with a subsequent bend in the draw-off tube. Furthermore, it can also be advantageous if the mouth features a multiple number of openings arranged along a ring, resulting in increased structural stability.

Furthermore, it is advantageous if air directing elements are provided in the area of the mouth. Such air directing elements are used to produce an air vortex, which flows around the thread and thus generates, amplifies, and/or maintains a twist of the thread, usually a Z twist. The air directing elements can be assigned to the draw-off tube, the thread outlet element, or both. The air vortex can also be generated by the fact that the compressed air nozzle is arranged with a component that is tangential to the mouth. As a result, the compressed air is blown in obliquely to the mouth and also generates an air vortex.

It is advantageous if a compressed air connection, in particular a compressed air coupling, is provided for connecting a compressed air hose. The compressed air hose can thus be designed to be detachable, which is advantageous, in particular, for maintenance work, with which the compressed air hose or the thread guide unit must be replaced (for example).

It is advantageous if a particularly ring-shaped air chamber is formed between the draw-off tube and the thread outlet element. The air chamber serves to distribute the compressed air before reaching the mouth of the compressed air nozzle. In this case, a uniform distribution of the compressed air, as can be achieved by a ring-shaped air chamber, is most advantageous. Advantageously, the thread outlet element is connected to the draw-off tube by gluing, welding, screwing, and/or pressing. Thus, the thread outlet element can be produced separately from the draw-off tube and is then connected to the draw-off tube by one of the specified processes. If the connection is separable, as for example upon screwing or pressing, thread outlet elements can also then be exchanged separately, for example if they are worn or if the thread guide unit is to be optimized for a different type of thread.

It is also advantageous if the draw-off tube features a change in direction, in particular in the form of a bend, such that the direction of the part of the draw-off tube on which the thread outlet element is arranged corresponds to the draw-off angle of the thread. In this case, a change in direction of the thread follows the change in direction of the draw-off tube. Thus, the change in direction of the thread can be controlled. Thus, a smooth change in direction of the draw-off tube results in a smooth change in direction of the thread, which has a gentle effect on the thread.

It is advantageous if the draw-off tube features a twist stop means. Thus, the twist generated by the rotor is stopped in the thread, such that the thread receives only a predetermined amount of twist and thus features predetermined properties. Furthermore, the draw-off tube advantageously features at least one thread sensor. With the assistance of such a thread sensor, it is possible to initially determine whether there is any thread in the draw-off tube at all. Thread breaks can also be detected at an early stage. In particular during the piecing process, the thread sensor can be used to determine when the thread end passes by the thread sensor. At least at this point in time, the position of the thread end is known. The position of the thread from the known initial position and the rotation of the draw-off rollers can then be calculated for a tensioned thread, which, for example, is held on the one side by draw-off rollers and tensioned on the other side by the compressed air. The knowledge of the position of the thread end is necessary, for example, for the precise piecing of the thread. The more precisely the thread is pieced, the greater the probability of it being successfully pieced, which in turn increases the productivity of the spinning unit.

It is advantageous if a fastening means is provided for fastening the thread guide unit to the spinning unit. In particular, in the case of a separable fastening means, the thread guide unit can thus be easily exchanged or removed for thorough cleaning. Furthermore, it is advantageous if a negative pressure connection is provided on the thread guide unit. With the assistance of a negative pressure connection, at least one part of the compressed air delivered by the compressed air nozzle can be sucked off again, which makes it easier for the supply of negative pressure associated with the rotor to maintain negative pressure. Furthermore, fiber fly, dirt, and thread pieces can be sucked out via the negative pressure connection, which supports the cleanliness of the thread guide unit.

Advantageously, the draw-off tube features an internal diameter that is between 2 mm and 4 mm, preferably between 2.5 mm and 3.5 mm, and more preferably approximately 3 mm. In this case, the internal diameter that the draw-off tube predominantly features is designated as the inner diameter. Internal diameters with the stated sizes have proved to be the optimum values for the withdrawal of a thread from a spinning assembly. It is also advantageous if the gap of the mouth features a thickness that is between 0.5% and 15%, preferably between 1.5% and 8%, and more preferably approximately 3.5%, of the inner diameter of the draw-off tube. By this, the thickness is the distance between the thread outlet element and the draw-off tube at the mouth. Here, with conventional pressures of the compressed air, the specified values enable a sufficiently strong compressed air flow and/or sufficiently strong air vortexes.

The thread guide unit is designed according to the preceding description, whereas the specified characteristics may be present individually or in any desired combination.

Furthermore, an open-end spinning machine with a multiple number of spinning units is proposed, whereas each spinning unit features a spinning assembly, a thread guide unit, draw-off rollers, a winding unit and a thread piecing unit. During spinning operation, the thread comes from the spinning assembly and is drawn off via the thread guide unit through the draw-off rollers. From the draw-off rollers, the thread then comes to the winding unit, which winds the thread onto a bobbin, in particular a cross-wound bobbin.

According to the invention, the thread guide unit is designed according to one of the preceding embodiments. The compact structural shape of the thread guide unit also helps the open-end spinning machine develop into a more compact or more efficient structural shape. The aforementioned advantages with respect to gentle thread treatment, improved maintainability, and increased productivity are, of course, also advantageous for the open-end spinning machine.

Finally, a method for operating a spinning unit of an open-end spinning machine is proposed. Herein, a spinning assembly produces a thread. The thread is drawn off from draw-off rollers by a thread guide unit and is wound by a winding unit onto a bobbin, in particular a cross-wound bobbin. If the thread has to be pieced, for example after a thread breakage or after a clearer cut, a thread piecing unit moves a thread end to the thread guide unit. There, the thread end is initially sucked into the thread guide unit, and then into the spinning assembly, by negative pressure prevailing in the spinning assembly.

According to the invention, a compressed air flow, which emerges in particular from a compressed air nozzle of the thread guide unit, supports the negative pressure prevailing in the spinning assembly and thus the sucking-in of the thread end into the spinning assembly, in a manner synchronized with the piecing of the thread. Due to the supported compressed air flow, the piecing of the thread takes place more rapidly and more precisely than with the negative pressure prevailing in the spinning assembly.

Advantageously, the thread guide unit is designed as described above. Thus, the thread may be treated more gently, the spinning unit is simpler and better maintained and productivity is increased.

It is also advantageous if the compressed air flow generates an air vortex. This can be achieved, for example, by air directing elements in the area of a mouth of the compressed air nozzle. Preferably, this air vortex generates and/or amplifies a twist, in particular a Z-twist, in the thread. This prevents the thread from losing its twist and possibly loosening. If, through the air vortex, the thread is subjected to additional rotations, this hardens the thread in the piecing area and improves the efficiency of the piecing process. However, the compressed air flow can also be blown through the compressed air nozzle during the drawing off of the spun thread through the draw-off tube, and can generate an air vortex. The air vortex causes a false twist in the thread, which leads to a crimped thread in a known manner.

It is advantageous if an additional compressed air flow, which emerges in particular from the compressed air nozzle of the thread guide unit, supports the sucking-in of the thread end into the thread guide unit. Moreover, the sucking-in of the thread end into the thread guide unit can thus take place more rapidly and more precisely. In addition, the stronger air flow can also detect a thread end that is not precisely positioned, which increases the probability that the piecing process is successful, and thus also the productivity of the spinning unit.

It is also advantageous if the thread end, after it has been sucked into the thread guide unit and into the spinning assembly, is prepared at the edge of a rotor of the spinning assembly. The preparation at the edge of the rotor, on the one hand, causes the thread to be shortened to a predetermined length. On the other hand, the fibers are partially freed from their rotation at the thread end, such that the new fibers are more easily connected to the thread end. As a whole, the preparation of the thread end at the edge of the rotor has the advantage that both the shortening of the thread and the release of the fibers from their rotation take place with the assistance of devices already present at the spinning unit. Thus, the rotor performs two or three different tasks. Preferably, a compressed air flow is blown through the compressed air nozzle during the sucking-in and/or preparation of the thread. As a result of the compressed air flow, a higher pulling force of the thread is herein achieved, and the thread is thus also more strongly tightened. Without an additional compressed air flow, in order to obtain the pulling force required for the preparation of the thread end, the thread would have to be sucked far into a main negative pressure channel, which entails numerous disadvantages: if several adjacent spinning units are piecing at the same time, there is a risk that thread braids will form in the main negative pressure channel. Moreover, given the negative pressure in the main negative pressure channel, which is usually not constant, over the length of the open-end spinning machine, different thread pulling forces arise, depending on the position of the spinning unit. Furthermore, the entire thread section located in the main negative pressure channel accrues as waste. With the assistance of the compressed air flow, the required thread pulling force is ideally already reached if the thread end is not yet in the main negative pressure channel. As a result, the specified disadvantages are eliminated or at least reduced. Advantageously, the thread end is withdrawn after it has been prepared at the edge of the rotor. Through this step, the positioning of the thread end in the rotor is improved, and the rotor can be accelerated without the thread end being rotated.

Likewise, it is advantageous if the thread end is prepared by hand outside the thread guide unit. By this, trained operating personnel can produce a very well-prepared thread end, with which the rotation of the fibers is canceled in the correct degree. In addition, the thread is only slightly shortened by hand during the preparation of the thread end, and little waste accrues. Furthermore, it is advantageous if the thread end is prepared in a thread end preparation assembly. Such a thread end preparation assembly also enables an optimum preparation of the thread end with a comparatively low waste volume. By this, the thread end preparation assembly can be assigned to a mobile maintenance unit, which is driven to the spinning unit for the piecing of the thread. The thread end preparation assembly can also be assigned to the spinning unit, whereas it is either a separate component or is preferably located in a side arm of the draw-off tube. If the thread end preparation assembly is arranged in the side arm of the draw-off tube, the thread piecing process can be carried out particularly rapidly, because the thread is already located in the draw-off tube and no longer has to be introduced into the draw-off tube.

It is also advantageous if the sucking-in of the thread end into the spinning assembly, in particular after the thread end has been withdrawn, is made possible by the rotation of a reversible stepping motor and/or by the loosening of a loop. By rotating a reversible stepping motor, the thread end can be conveyed into the spinning assembly by a predetermined distance. Likewise, the thread end is conveyed to the spinning assembly by a predetermined distance through the loosening of a loop, provided that the loop has a predetermined length. The thread end is thus moved in a controlled manner during the piecing process, which leads to reproducible results. This is advantageous both for the quality of the connection of the thread end with the newly spun thread and for the reliability of the piecing process.

In summary, a piecing process can thus proceed as follows: the thread end is moved by a thread piecing unit to the thread guide unit. A spinning box assigned to the spinning unit or the spinning assembly is closed and the thread end is sucked into the thread guide unit. The spinning box is now opened and the thread is unwound, such that the thread end is conveyed into a suction device of the spinning box or the spinning assembly. The spinning box is then closed, but not completely, whereby the thread is pressed against the edge of the rotor. The rotor is now accelerated and the thread is pulled back and forth several times, whereby the thread is separated and prepared at the rotor edge. The thread is then withdrawn from the rotor, but only so far that it is still located in the thread guide unit. After the spinning assembly has been closed, the thread is fed back into the rotor for piecing.

Furthermore, it is advantageous if the position of the thread end is detected by means of at least one sensor in a draw-off tube assigned to the thread guide unit. As a result of the known position of the thread end, the piecing process can be controlled even more precisely, for example through the length of the thread return, or through the selection of the points of time of the ramp-up of the rotor or the commencement of the drawing off of the thread. Preferably, the compressed air flow is controlled taking into account the position of the thread end. The piecing of the thread end can also be influenced by the compressed air flow. By this, the point in time and term and, if applicable, the strength of the compressed air flow can be influenced.

Finally, it is advantageous if a compressed air flow is blown through the compressed air nozzle for cleaning the thread guide unit and/or the spinning assembly at time intervals. By this, cleaning by means of compressed air can be carried out efficiently and with the available means. Thus, more complex (for example, mechanical) cleaning operations can be carried out with longer time intervals from one another. On the other hand, the cleaning with the compressed air flow blown through the compressed air nozzle can be carried out prior to each piecing process and even during the running spinning operation.

The method for operating a spinning unit is carried out according to the preceding description, whereas the specific characteristics can be present individually or in any desired combination.

BRIEF DESCRIPTION OF THE DRAWINGS

Further advantages of the invention are described in the following embodiments. The following is shown.

DETAILED DESCRIPTION

Figure 1A:
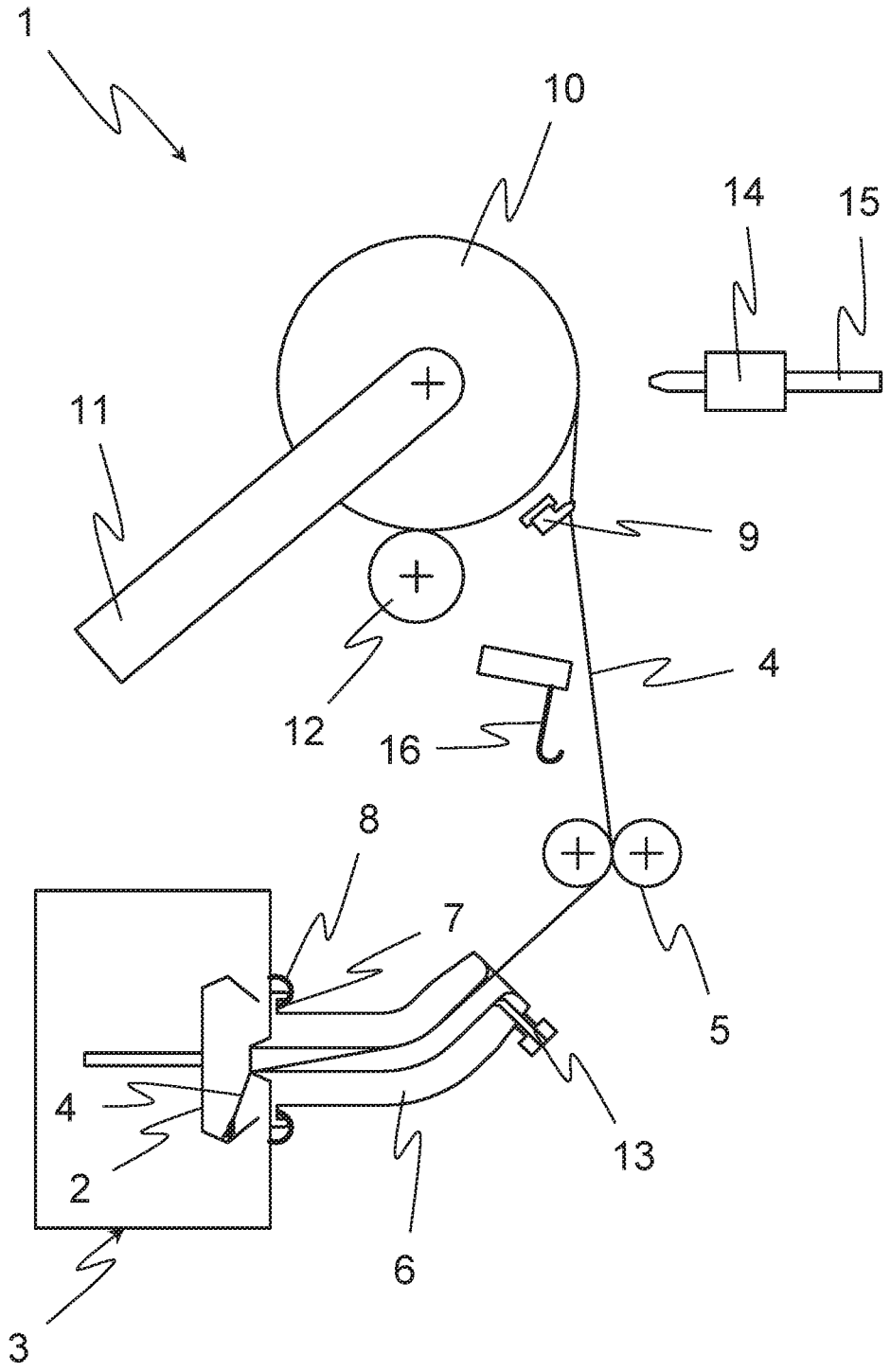
FIGS. 1*a*, 1*b* and 1*c* are schematic side views of a spinning unit of an open-end spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1*a* shows a schematic side view of a spinning unit 1 of an open-end spinning machine during spinning operation. Fiber material is introduced into a rotor 2 of a spinning assembly 3 of the spinning unit and is spun into a thread 4. The thread 4 is drawn off out of the rotor 2 by a pair of draw-off rollers 5 via a thread guide unit 6. The thread guide unit 6 features a groove 7, into which a holding spring 8 of the spinning assembly 3 engages and thus connects the thread guide unit 6 with the spinning assembly 3. After the pair of draw-off rollers 5, the thread 4 is wound by a traverse unit 9 onto a cross-wound bobbin 10. The cross-wound bobbin 10 is held by a bobbin holder 11 and is driven by a drive roller 12.

At time intervals, a compressed air flow is blown through a compressed air nozzle 13 of the thread guide unit 6 for cleaning the thread guide unit 6 and the spinning assembly 3. Dirt and fiber fly are thereby detached and sucked off by a vacuum device (not shown here) of the spinning assembly 3. During spinning operation, a suction nozzle 15, which can be displaced by a drive 14, and a thread catcher 16 are not required.

Figure 1B:
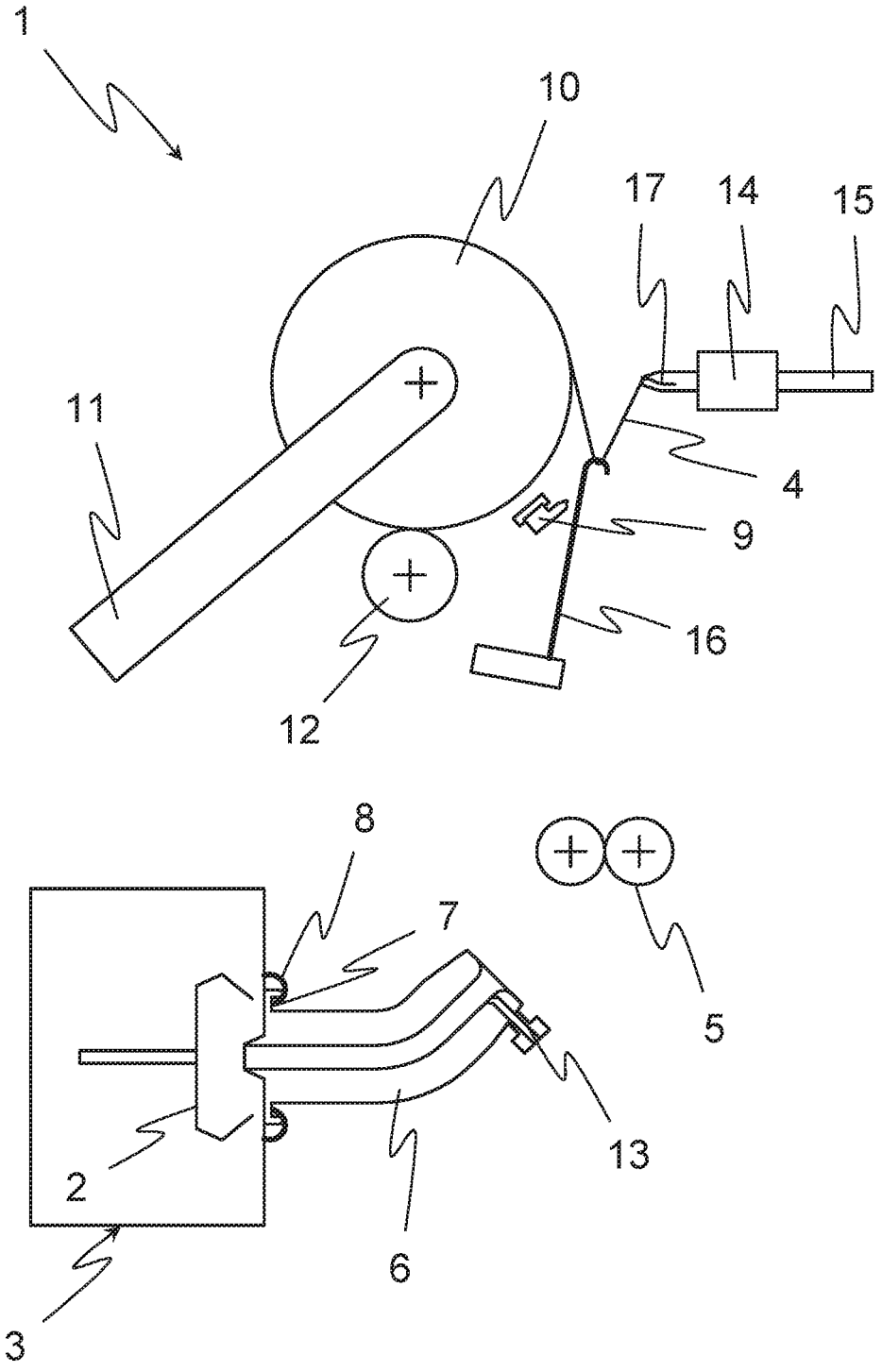

Referring to FIG. 1*b*, after a thread break or a clearer cut, the thread 4 runs onto the cross-wound bobbin 10. In order to obtain a continuous thread 4 on the cross-wound bobbin 10, the thread end 17 must initially be found and then located at the spinning assembly 3. For seeking the thread end 17, the suction nozzle 15 is displaced by the drive 14 in such a manner that the opening of the suction nozzle 15 is located just above the surface of the cross-wound bobbin 10. The cross-wound bobbin 10 is then rotated by the drive roller 12 slowly opposite the direction of rotation during spinning operation until the thread end 17 is sucked into the suction nozzle 15. Then, the suction nozzle 15 is removed again from the cross-wound bobbin 10 by the drive 14, such that the thread 4 is tensioned between the cross-wound bobbin 10 and the suction nozzle 15. The thread catcher 16 can then grip the tensioned thread 4. Such point in time is shown in FIG. 1*b*.

Figure 1C:
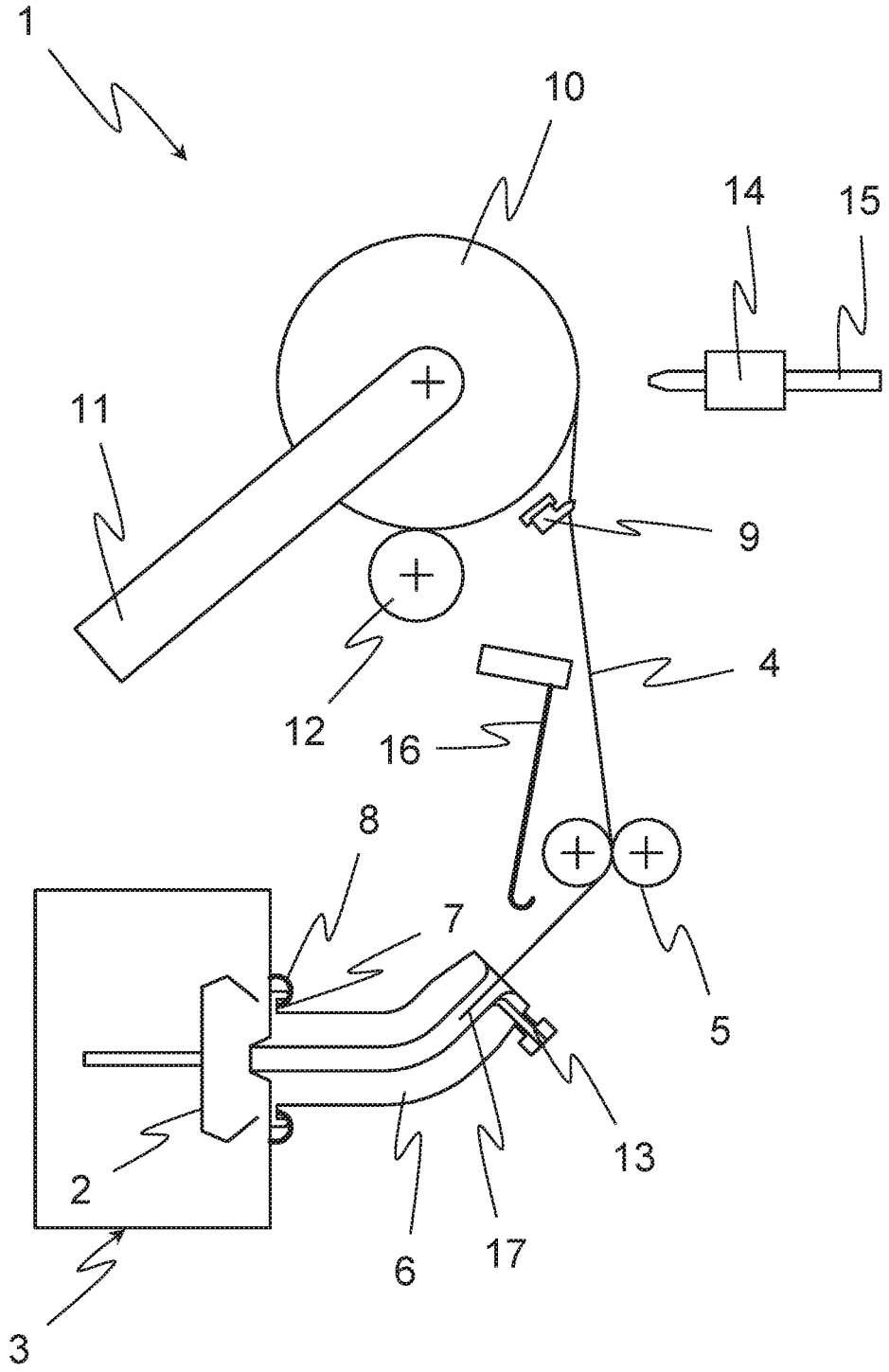

The thread 4 is then inserted by the thread catcher 16 into the traverse unit 9 and the draw-off roller pair 5, and is moved up to the opening of the thread guide unit 6. There, the thread 4 is sucked into the thread guide unit 6 by the negative pressure prevailing in the spinning assembly 3. This process is supported by a compressed air flow blown through the compressed air nozzle 13. The thread end 17 is now located in the thread guide unit 6, as shown in FIG. 1*c*.

In the further course of the piecing process, the pair of draw-off rollers 5 is then rotated backwards, such that the thread end 17 is moved further into the thread guide unit 6 up to the rotor 2 by the negative pressure prevailing in the spinning assembly 3, assisted by the compressed air flow from the compressed air nozzle 13. At the rotating rotor edge, the thread end 17 is then separated and prepared. Thereupon, the thread end 17 is withdrawn somewhat by the pair of draw-off rollers 5. Subsequently, the actual piecing takes place, in which the rotor 2 is ramped up to its piecing speed and the pair of draw-off rollers 5 is rotated backwards. The thread end 17 is thereby conveyed into the rotor 2, where it is connected to fibers located there, by the negative pressure prevailing in the spinning assembly 3, combined with a synchronized compressed air flow from the compressed air nozzle 13. The normal spinning operation is then resumed.

Figure 2:
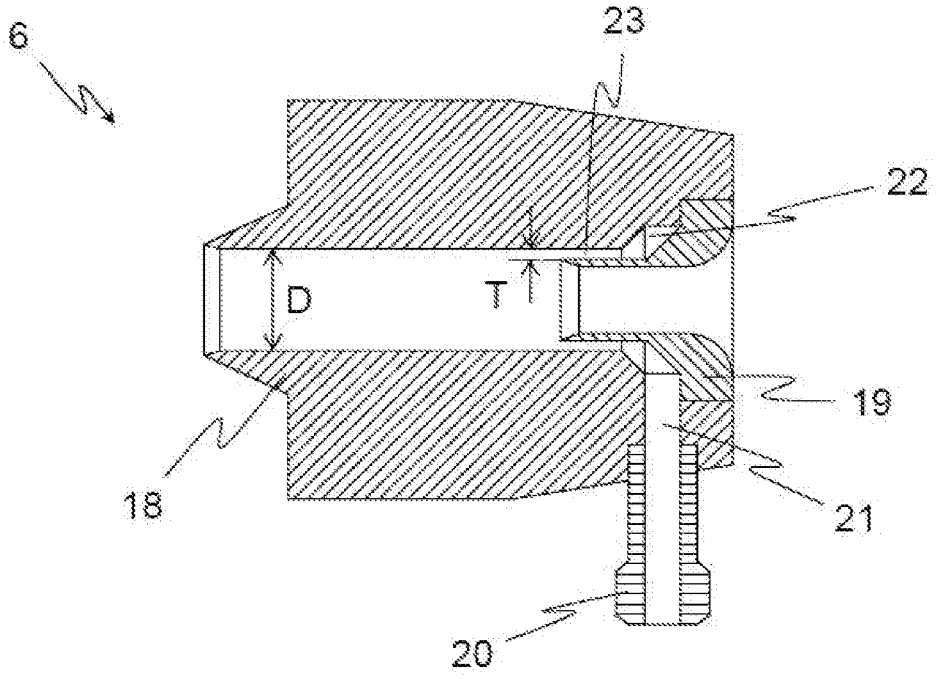
FIG. 2 is a longitudinal section of a thread guide unit.

FIG. 2 shows a longitudinal section of a simple thread guide unit 6. The thread guide unit 6 features a draw-off tube 18 with an inside diameter D along with a thread outlet element 19. A compressed air connection 20 leads to a compressed air nozzle 21, which is provided as a recess in the draw-off tube 18. The compressed air nozzle 21 also comprises a ring-shaped air chamber 22, which is formed between the draw-off tube 18 and the thread outlet element 19. The compressed air is distributed evenly through this ring-shaped air chamber 22. Finally, a mouth 23 of the compressed air nozzle 21 is formed as a gap between the draw-off tube 18 and the thread outlet element 19. This enables a particularly compact structural shape. Herein, the thickness T of this gap influences the strength of the compressed air flow that can be achieved. The mouth 23 is also ring-shaped, such that the compressed air flow can emerge in a uniformly distributed manner, and can flow around the thread from all sides. Thus, the compressed air flow is most efficiently utilized and the thread is treated most gently.

During spinning operation, a thread from the rotor is drawn off by a pair of draw-off rollers through the draw-off tube 18. The thread leaves the thread guide unit 6 at the thread outlet element 19. As described above, the compressed air nozzle 21 is required to blow the thread in the direction of the rotor. In addition, a compressed air flow blown through the compressed air nozzle 21 can be used to clean the draw-off tube and/or the spinning assembly.

Figure 3:
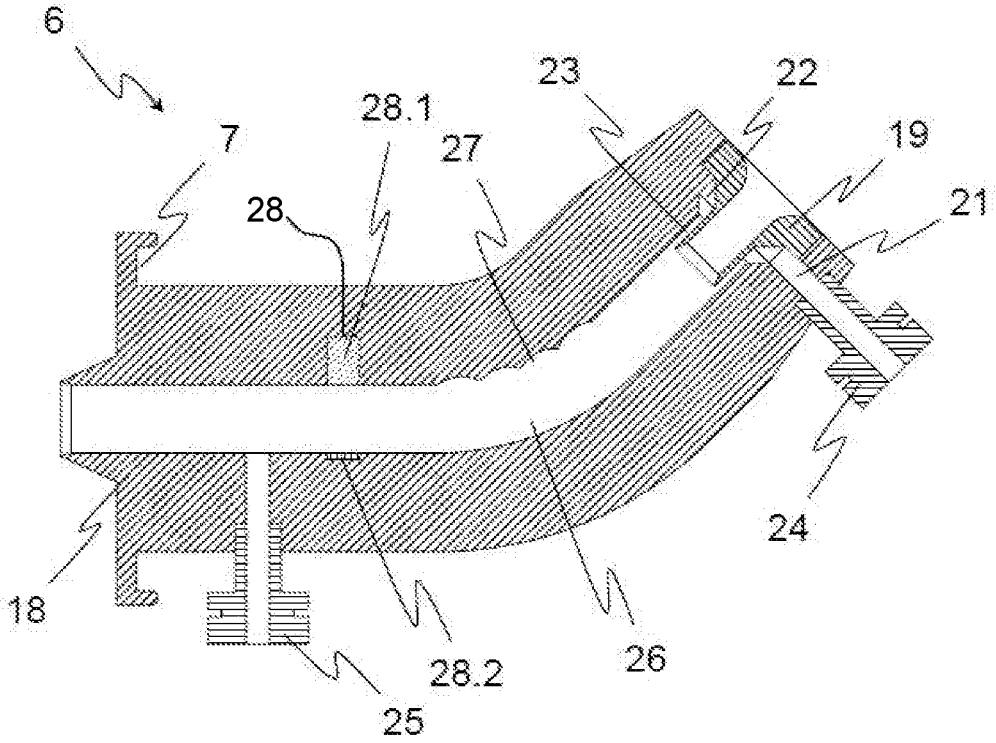
FIG. 3 is a longitudinal section of an additional thread guide unit.

With the following description of the alternative thread guide unit 6 shown in FIG. 3, the same reference signs are used for characteristics that, in their design and/or mode of operation, are identical and/or at least comparable in comparison to the first embodiment shown in FIG. 2. To the extent that such are not described once again in detail, their designs and/or modes of action correspond to the designs and modes of action of the characteristics described above. For the sake of clarity, the internal diameter D and the thickness T are no longer marked in these and the following figures.

For the more rapid connection and disconnection of a compressed air hose, the thread guide unit 6 features a compressed air coupling 24. Compared to a conventional compressed air connection, this provides a time advantage, in particular during maintenance and/or cleaning work.

Furthermore, the thread guide unit 6 features a negative pressure connection 25, which is also formed as an air coupling. Negative pressure is switched on, for example, via the negative pressure connection 25, if a thread end is first sucked into the thread guide unit 6. This negative pressure then assists the negative pressure prevailing in the spinning assembly and sucks off at least one part of the compressed air blown in by the compressed air nozzle 21. The negative pressure is also switched on if the draw-off tube 18 is cleaned by means of compressed air. Dirt and fiber fly are then sucked through the negative pressure line.

The thread guide unit 6 further comprises a groove 7. In cooperation with holding springs of the spinning assembly, this groove 7 serves to fasten the thread guide unit 6 to the spinning assembly.

The draw-off tube 18 features a bend 26, such that the thread is at least essentially drawn off in the direction of the part of the draw-off tube 18 on which the thread outlet element 19 is arranged. Thus, the change in direction of the thread at the thread outlet element 19 is very small, which results in a correspondingly low friction of the thread at the thread outlet element 19.

The draw-off tube 18 also features twist stop means 27. As a result, the twist generated by the rotation of the rotor is stopped in the thread, which results in a defined twist in the thread, and the thread properties thus remaining constant.

Finally, a thread sensor 28 is provided in the draw-off tube 18. The thread sensor 28 consists of a light barrier unit 28.1 and a mirror 28.2. By this, a light source of the light barrier unit 28.1 radiates light onto the mirror 28.2. Then, the light reflected by the mirror 28.2 is in turn detected by a light sensor of the light barrier unit 28.1. If a thread is located in the draw-off tube 18 in the area of the thread sensor 28, the light is blocked by the thread or at least weakened, and the light sensor determines, that a thread is located in the draw-off tube 18. Since the position of the thread sensor 28 in the draw-off tube 18 is known, even the position of the thread end can be registered, if the point in time at which the thread blocks or releases the light is recorded. With the assistance of the detected position of the thread end, the piecing process can then be carried out more precisely.

Figure 4:
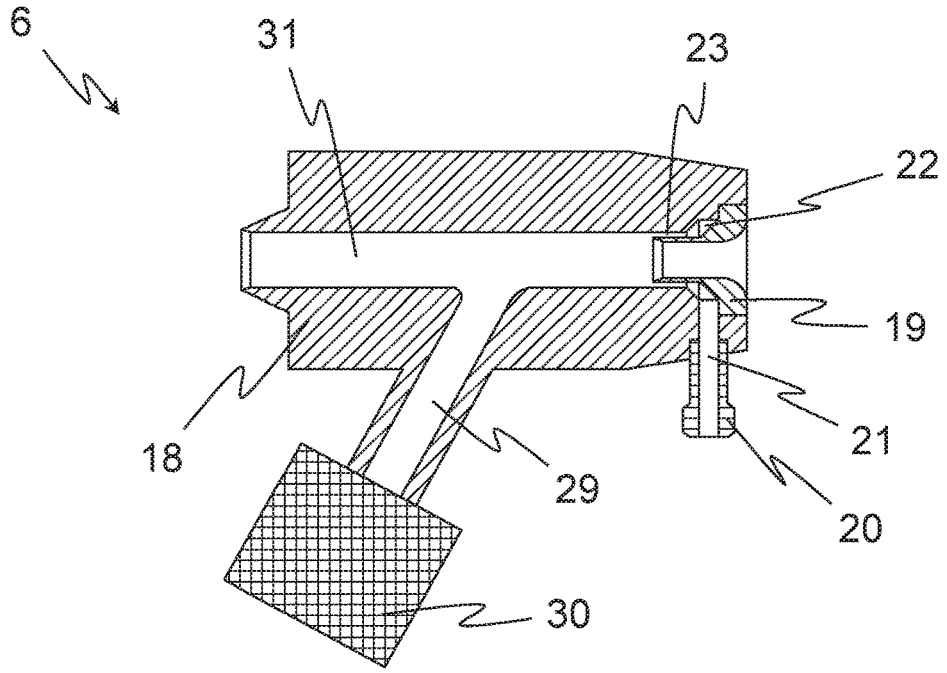
FIG. 4 is a longitudinal section of an additional thread guide unit.

With the embodiment of a thread guide unit 6 shown in FIG. 4, the draw-off tube 18 features a side arm 29. This side arm 29 leads to a thread end preparation assembly 30, which is shown here only schematically. If, for example, the thread is to be pieced after a thread break, then, as described above, the thread end is sucked into the thread guide unit 6. If negative pressure is then applied to the side arm 29, the thread end reaches the thread end preparation assembly 30 via the side arm 29, where the thread end is shortened and the twist of the fibers is partially canceled. The thread end is now withdrawn somewhat, such that it is no longer located in the side arm 29. For the further piecing of the thread end, negative pressure is now applied to the main arm 31 of the draw-off tube 18, and the process continues as described above.

Figure 5:
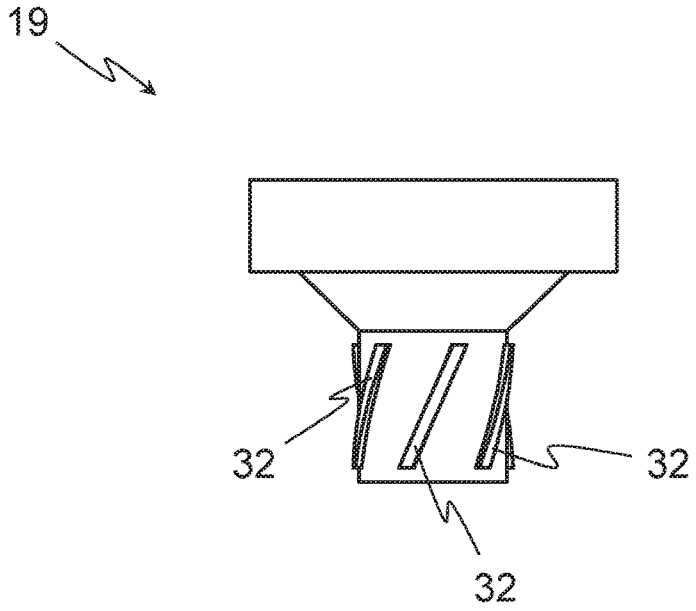
FIG. 5 is a side view of a thread outlet element.

FIG. 5 shows a side view of an alternative embodiment of a thread outlet element 19. Such thread outlet element 19 is provided with air directing elements 32. If compressed air is now blown between the thread outlet element 19 and the draw-off tube 18, an air vortex is generated in the compressed air flow through the air directing elements 32. With the assistance of such air vortex, a twist, typically a Z-twist, is generated in the thread, or the twist is maintained in the thread and does not loosen. However, the air directing elements 32 can also be assigned to the draw-off tube 18, or partially to the thread outlet element 19 and partially to the draw-off tube 18.

Figures 6A, 6B, 6C:
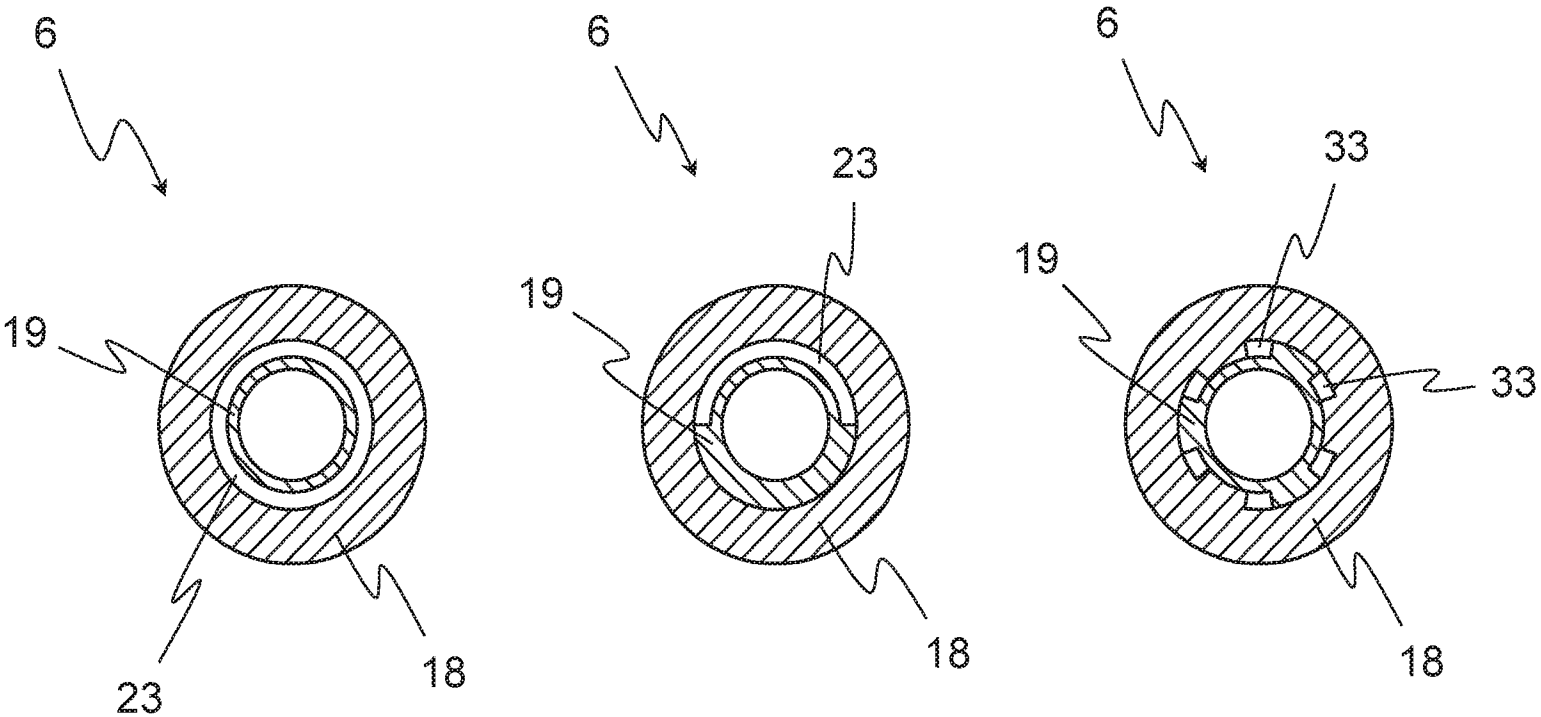
FIGS. 6*a*, 6*b* and 6*c* are cross-sections through different thread guide units.

FIGS. 6*a*, 6*b* and 6*c* show cross-sections of different embodiments of thread guide units 6, whereas the cross-sections are in the area of the mouth 23.

In FIG. 6*a*, the mouth 23 is ring-shaped. This ensures a uniform circulation of the thread with compressed air and is particularly gentle to the thread.

FIG. 6*b* shows a semi-circular mouth 23. Such a mouth 23 is used in particular if, for example, a specific direction of the thread is predetermined by a bend 26 in the draw-off tube 18, and the compressed air flow is to direct the thread in such direction.

Furthermore, FIG. 6*c* shows a mouth 23 with which a multiple number of openings 33 are arranged along a ring, of which only two are provided with a reference sign for the sake of clarity. Such a design of the mouth 23 offers an increased stability of the thread guide unit 6 in the area of the mouth 23.

Figure 7:
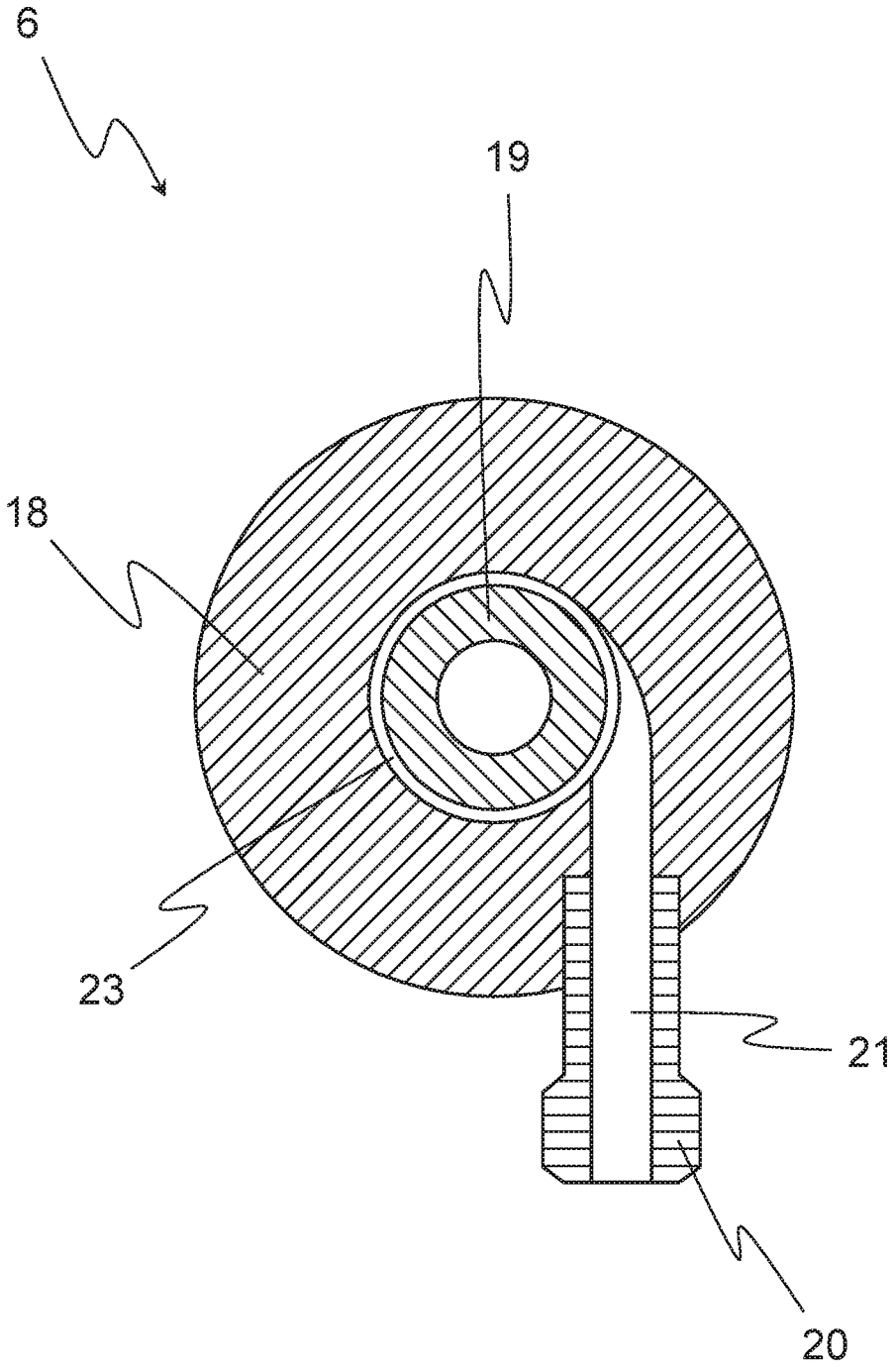
FIG. 7 is a cross-section through an additional thread guide unit.

Furthermore, FIG. 7 shows a cross-section through an additional thread guide unit 6. With this thread guide unit 6, the compressed air nozzle 21 opens directly into the mouth 23. In addition, the compressed air nozzle 21 is offset with respect to the axis of the draw-off tube 18 and of the thread outlet element 19 and is thus arranged with components tangential to the mouth 23. By means of this offset arrangement of the compressed air nozzle 21, the air that is blown receives a tangential component, such that, here as well, an air vortex is generated, with the aforementioned advantages. A combination of the compressed air nozzle arranged tangentially with the mouth with air directing elements is also conceivable, such that an air vortex of the correct strength is generated.

Figure 8:
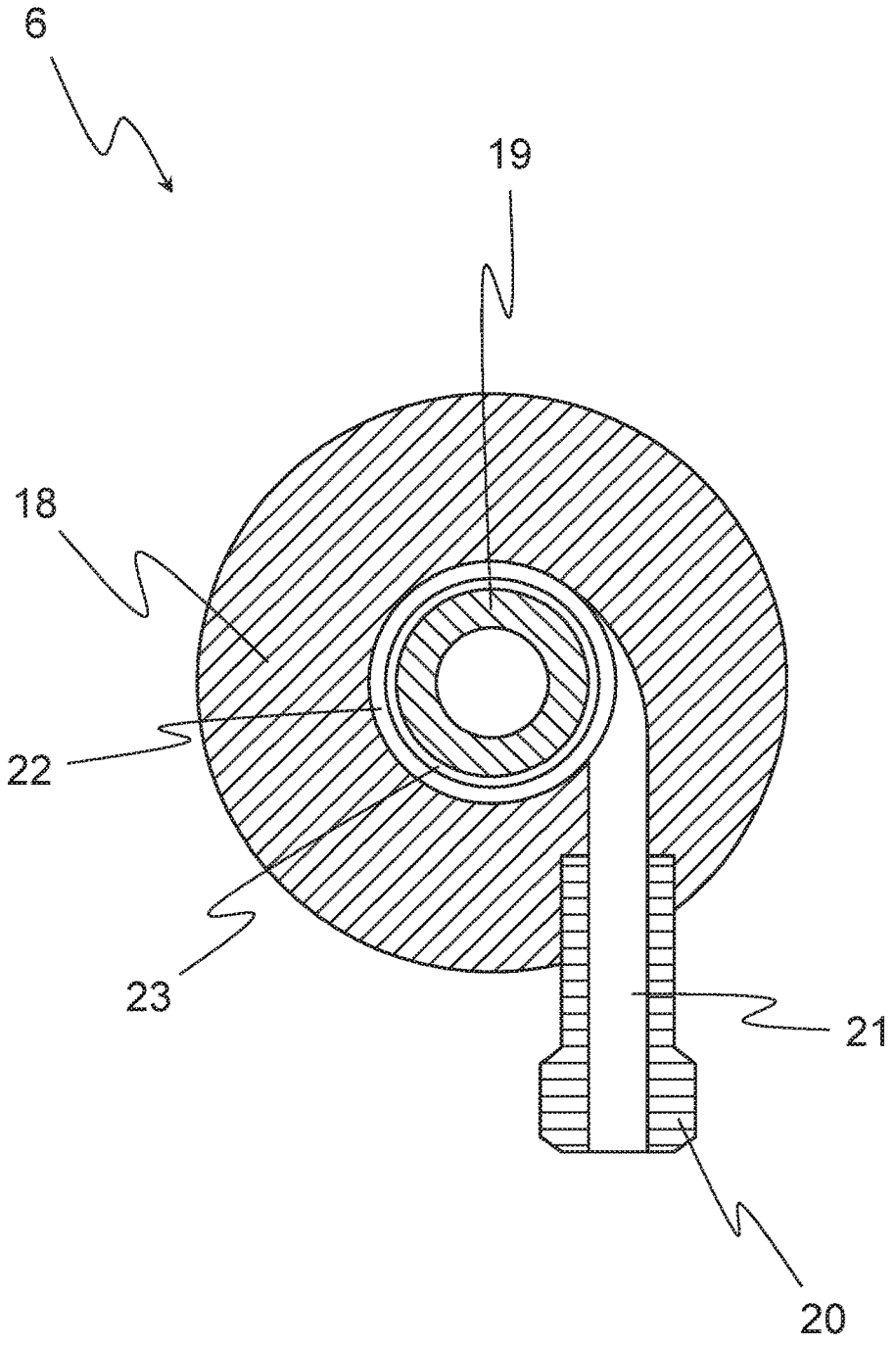
FIG. 8 is a cross-section through an additional thread guide unit.

Finally, FIG. 8 shows a cross-section through an additional thread guide unit 6. This thread guide unit 6 features, in addition to the mouth 23, a ring-shaped air chamber 22. Similar to the embodiment of FIG. 7, the compressed air nozzle 21 is offset with respect to the axis of the draw-off tube 18, the thread outlet element 19 and the ring-shaped air chamber 22, and thus features a component tangential to the mouth 23. Here as well, the blown air receives a tangential component through the offset arrangement of the compressed air nozzle 21. This also generates an air vortex, with the advantages described above.

Furthermore, a combination of the embodiments of FIGS. 7 and 8 is also conceivable. In this case the compressed air is blown in such a way that part of the compressed air initially flows into the ring-shaped air chamber 22 and only reaches the mouth 23 from there. The other part of the compressed air is blown directly into the mouth 23. Thus, both parts of the compressed air flow come together once again in the mouth. Thus, a particularly effective air vortex can be generated.

This invention is not limited to the illustrated and described embodiments. Variations within the scope of the claims, just as the combination of characteristics, are possible, even if they are illustrated and described in different embodiments.

LIST OF REFERENCE SIGNS

1 Spinning unit
2 Rotor
3 Spinning assembly
4 Thread
5 Pair of draw-off rollers
6 Thread guide unit
7 Groove
8 Holding spring
9 Traverse unit
10 Cross-wound bobbin
11 Bobbin holder
12 Drive roller
13 Compressed air nozzle
14 Engine
15 Suction nozzle
16 Thread catcher

17 Thread end
18 Draw-off tube
19 Thread outlet element
20 Compressed air connection
21 Compressed air nozzle
22 Ring-shaped air chamber
23 Mouth
24 Compressed air coupling
25 Negative pressure connection
26 Bend
27 Twist stop means
28 Thread sensor
29 Side arm
30 Thread end preparation assembly
31 Main arm
32 Air directing element
33 Opening
D Internal diameter
T Thickness

The invention claimed is:

1. A thread guide unit for drawing off a thread out of a rotor of a spinning unit of an open-end spinning machine, comprising:

a draw-off tube, the draw-off tube having a first end, an opposite second end, and a continuous inner diameter surface between the first end and the opposite second end, wherein the draw-off tube is configured such that during spinning operations at the spinning unit, the first end is adjacent and concentric with an open-end of the rotor to draw a spun yarn out from a center of the rotor and into the draw-off tube;

a compressed air nozzle configured with the draw-off tube;

a thread outlet element extending into the second end of the draw-off tube;

the compressed air nozzle comprising a mouth formed as a gap between the inner diameter surface of the draw-off tube and the thread outlet element, wherein compressed air is directed into and along the gap from the compressed air nozzle; and means for generating a vortex in the compressed air flowing through the gap and into the draw-off tube to generate or maintain a twist in the thread in the draw-off tube.

2. The thread guide unit according to claim 1, wherein the mouth of the compressed air nozzle has one of a ring or semi-circular shape and comprises a plurality of openings arranged along a ring that extends radially outward towards the inner diameter surface of the draw-off tube.

3. The thread guide unit according to claim 1 wherein the vortex generating means comprises air directing elements in the gap formed on one or both of the inner diameter surface of the draw-off tube or an outer diameter surface of the thread outlet element.

4. The thread guide unit according to claim 1, wherein the vortex generating means comprises an offset of the compressed air nozzle relative to an axis of the draw-off tube so as to introduce the compressed air to the mouth with a tangential component to generate the vortex.

5. The thread guide unit according to claim 1, further comprising a compressed air coupling on the compressed air nozzle to connect a compressed air hose.

6. The thread guide unit according to claim 1, wherein a ring-shaped air chamber is formed between the draw-off tube and the thread outlet element.

7. The thread guide unit according to claim 1, wherein the draw-off tube comprises a bend such that a direction of a part of the draw-off tube on which the thread outlet element is arranged corresponds to a draw-off angle of thread from the thread guide unit.

8. The thread guide unit according to claim 1, wherein the draw-off tube further comprises a twist stop device.

9. The thread guide unit according to claim 1, wherein the draw-off tube further comprises a thread sensor.

10. The thread guide unit according to claim 1, further comprising a fastening device that connects the thread guide unit to the spinning unit.

11. The thread guide unit according to claim 1, further comprising a negative pressure connection provided on the draw-off tube.

12. The thread guide unit according to claim 1, wherein the inner diameter surface of the draw-off tube comprises a cylindrical surface with a diameter (D) between 2 mm and 4 mm and the gap has a thickness (T) that is between 0.5% and 15% of the inner diameter (D) of the draw-off tube.

13. An open-end spinning machine with a plurality of spinning units, wherein each spinning unit comprises a spinning assembly, draw-off rollers, a winding unit, a thread piecing unit, and the thread guide unit according to claim 1.

* * * * *